US009837226B2

(12) United States Patent
Ju et al.

(10) Patent No.: US 9,837,226 B2
(45) Date of Patent: Dec. 5, 2017

(54) DOME-SHAPED PUSH SWITCH

(71) Applicant: LOTES CO., LTD, Keelung (TW)

(72) Inventors: Ted Ju, Keelung (TW); Yin Fu Zhu, Keelung (TW); Shuang Bo Long, Keelung (TW); Yu Song Zhou, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/241,611

(22) Filed: Aug. 19, 2016

(65) Prior Publication Data

US 2017/0316898 A1 Nov. 2, 2017

(30) Foreign Application Priority Data

Apr. 28, 2016 (CN) ..... 2016 2 0373327 U

(51) Int. Cl.

| | |
|---|---|
| ***H01H 1/10*** | (2006.01) |
| ***H01H 13/26*** | (2006.01) |
| ***H01H 1/06*** | (2006.01) |
| ***H01H 5/04*** | (2006.01) |

(52) U.S. Cl.

CPC ..... *H01H 13/26* (2013.01); *H01H 1/06* (2013.01); *H01H 5/04* (2013.01); *H01H 2203/05* (2013.01)

(58) Field of Classification Search

CPC .. H01H 13/44; H01H 13/48; H01H 2205/018; H01H 2205/026; H01H 2215/016; H01H 2215/024; H01H 2225/018; H01H 2239/004; H01H 2215/022; H01H 13/26; H01H 1/06; H01H 5/04; H01H 2203/05; H01H 2013/12; H01H 2013/50; H01H 2003/12

USPC ..... 200/512, 5 A, 159 B, 159 A, 5 R, 275, 200/279, 292

See application file for complete search history.

(56) References Cited

U.S. PATENT DOCUMENTS

2008/0142350 A1* 6/2008 Karaki ..... H01H 13/702 200/512

2010/0140065 A1* 6/2010 Lee ..... H01H 13/48 200/17 R

* cited by examiner

*Primary Examiner* — Anthony R. Jimenez

(74) *Attorney, Agent, or Firm* — Locke Lord LLP; Tim Tingkang Xia, Esq.

(57) ABSTRACT

A dome-shaped push switch includes a sheet and a conducting layer disposed at a low surface of the sheet. The sheet has a pressing portion arching upward. The conducting layer is disposed at a lower surface of the sheet. The conductivity of the sheet is greater than that of the sheet. The pressing portion includes at least one through hole penetrating through the pressing portion. The through hole has a side wall, the side wall sequentially has a shear surface and a tear surface from bottom up, and a fillet is provided between the shear surface and a lower surface of the pressing portion.

20 Claims, 10 Drawing Sheets

DOME-SHAPED PUSH SWITCH

CROSS-REFERENCE TO RELATED APPLICATIONS

This non-provisional application claims priority to and benefit of, under 35 U.S.C. §119(a), Patent Application No. 201620373327.8 filed in P.R. China on Apr. 28, 2016, the entire content of which is hereby incorporated by reference.

FIELD OF THE INVENTION

The present invention relates generally to a dome-shaped push switch, and more particularly to a dome-shaped push switch of an electronic device such as a watch and a cellphone.

BACKGROUND OF THE INVENTION

The background description provided herein is for the purpose of generally presenting the context of the present invention and is neither expressly nor impliedly admitted as prior art against the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

U.S. Patent Application Publication No. 20140054155 discloses a dome-shaped movable contact piece with a long stroke, that is, a long indentation amount, of a switch of an input operation part of a keyboard of a portable phone or an electronic device. The movable contact piece includes a dome-shaped contact piece arching upward. The dome-shaped contact piece is provided with four substantially triangular notches that are located between a central portion of the dome-shaped contact piece and a peripheral portion of the dome-shaped contact piece. Chamfering corner portions or vertex angle portions of the notches may prevent a crack from being generated on the dome-shaped contact piece. However, it should be noted that four notches are formed on the dome-shaped contact piece, and accordingly, four connection portions are formed. When the dome-shaped contact piece is subjected to a pressure and is elastically deformed, the four connection portions are subjected to partial contraction and partial expansion. When the dome-shaped contact piece is repeatedly pressed for multiple times, the four connection portions are subjected to repeated partial contraction and partial expansion, and cracks may easily occur on side walls (that is, the side walls of the notches), particularly in positions subjected to the partial expansion.

Therefore, a heretofore unaddressed need exists in the art to address the aforementioned deficiencies and inadequacies.

SUMMARY OF THE INVENTION

In one aspect, the present invention relates to a novel dome-shaped push switch that is usable for an electronic device such as a watch and a cellphone, and the dome-shaped push switch may be repeatedly pressed for millions of times without generating a crack, so as to prolong a service life of a relevant electronic device.

In one embodiment, a dome-shaped push switch includes a sheet having a pressing portion arching upward and a conducting layer disposed at a lower surface of the sheet. The conductivity of the conducting layer is greater than that of the sheet. The pressing portion has at least one through hole penetrating through the pressing portion. The through hole has a side wall. The side wall sequentially has a shear surface and a tear surface from bottom up. A fillet is provided between the shear surface and a lower surface of the pressing portion.

In one embodiment, the roughness of the tear surface is greater than the roughness of the shear surface.

In one embodiment, the tear surface extends downward from an upper edge of the side wall to the shear surface.

In one embodiment, the sheet further includes a support portion disposed at an edge of the pressing portion, for contacting with a substrate.

In one embodiment, the support portion is formed by bending and extending obliquely upward from the edge of the pressing portion.

In one embodiment, the substrate has a first pad, and the support portion is in contact with the first pad.

In one embodiment, the substrate has a second pad, and the pressing portion is in contact with the second pad after the pressing portion is pressed.

In one embodiment, the pressing portion includes a sustaining portion located at the top of the pressing portion and configured to receive a pressing member. A pressure is applied to the pressing portion by the pressing member. The at least one through hole is located around the sustaining portion.

In one embodiment, the dome-shaped push switch further includes a chamfer disposed at a part of the fillet.

In one embodiment, the chamfer is formed by squeezing.

In one embodiment, the sheet is formed by stretching a thick plate along a direction. The pressing portion is provided with four through holes. A connection portion is provided between every two adjacent through holes of the four through holes. An angle between a longitudinal direction of one of the connection portions and the stretching direction of the thick plate is between 15° and 35°.

In one embodiment, an angle between two adjacent connection portions is 90°.

As compared with the related art, in certain embodiments of the present invention, the dome-shaped push switch is obtained by performing blanking on the sheet to form the through hole and then punching and bending the sheet to form the arched pressing portion, where a blanking direction for forming the through hole is consistent with an arching direction of the pressing portion. The dome-shaped push switch is provided with the pressing portion arching upward. The pressing portion is provided with the through hole penetrating through the pressing portion. The through hole has a side wall. The side wall sequentially has a shear surface and a tear surface from bottom up. When the dome-shaped push switch is pressed and is elastically deformed, the dome-shaped push switch is subjected to partial contraction and partial expansion. An elastic deformation state of the dome-shaped push switch may be analyzed by dividing the dome-shaped push switch into two layers along a thickness direction, an inner layer and an outer layer. The inner layer of the dome-shaped push switch has an increase in size and is elastically expanded, and the outer layer of the dome-shaped push switch has a decrease in size and is elastically contracted. It is no doubt that the inner layer that is elastically expanded due to the increase in size is more likely to generate a crack. The side wall sequentially has a shear surface and a tear surface from bottom up, and therefore, the smooth and compact shear surface is substantially located at the inner layer that is elastically expanded due to the increase in size. It should be noted that it can be observed from an electron microscope that the shear surface is more smooth and compact as compared with the tear surface. Naturally, the shear surface has a better tear resistance. Therefore, in the present invention, the feature of a high tear resistance of the shear surface is sufficiently used, so as to reduce a risk of generating a crack at a lower side of the side wall, that is, reduce a risk of generating a crack at a position, subjected to partial expansion, of the dome-shaped push switch, thereby effectively improving the overall durability of the dome-shaped push switch and prolonging a service life of the dome-shaped push switch.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
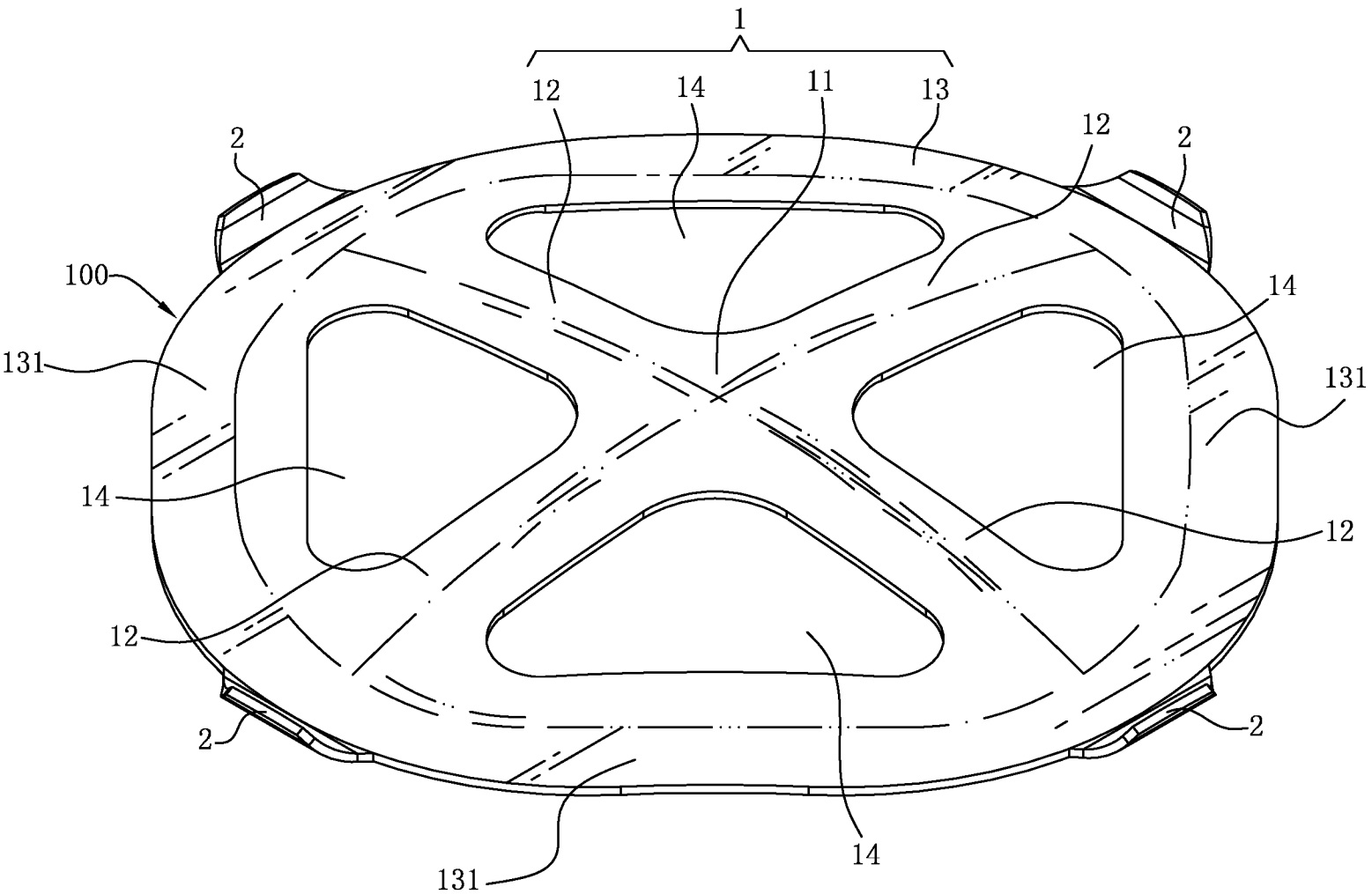
FIG. 1 is a schematic three-dimensional view of a dome-shaped push switch according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a dome-shaped push switch.

Figure 2:
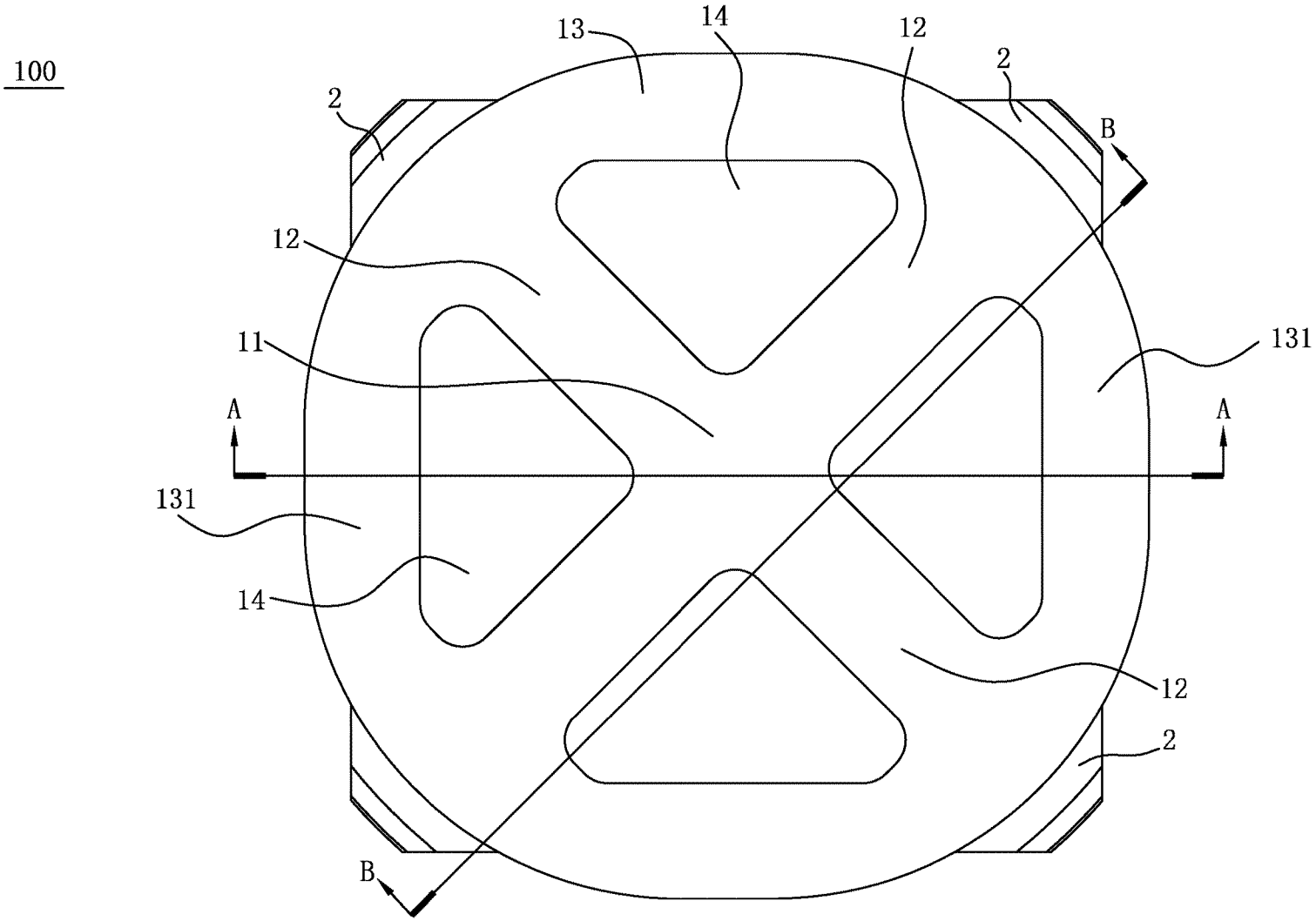
FIG. 2 is a schematic top view of a dome-shaped push switch according to one embodiment of the present invention.
Figure 6:
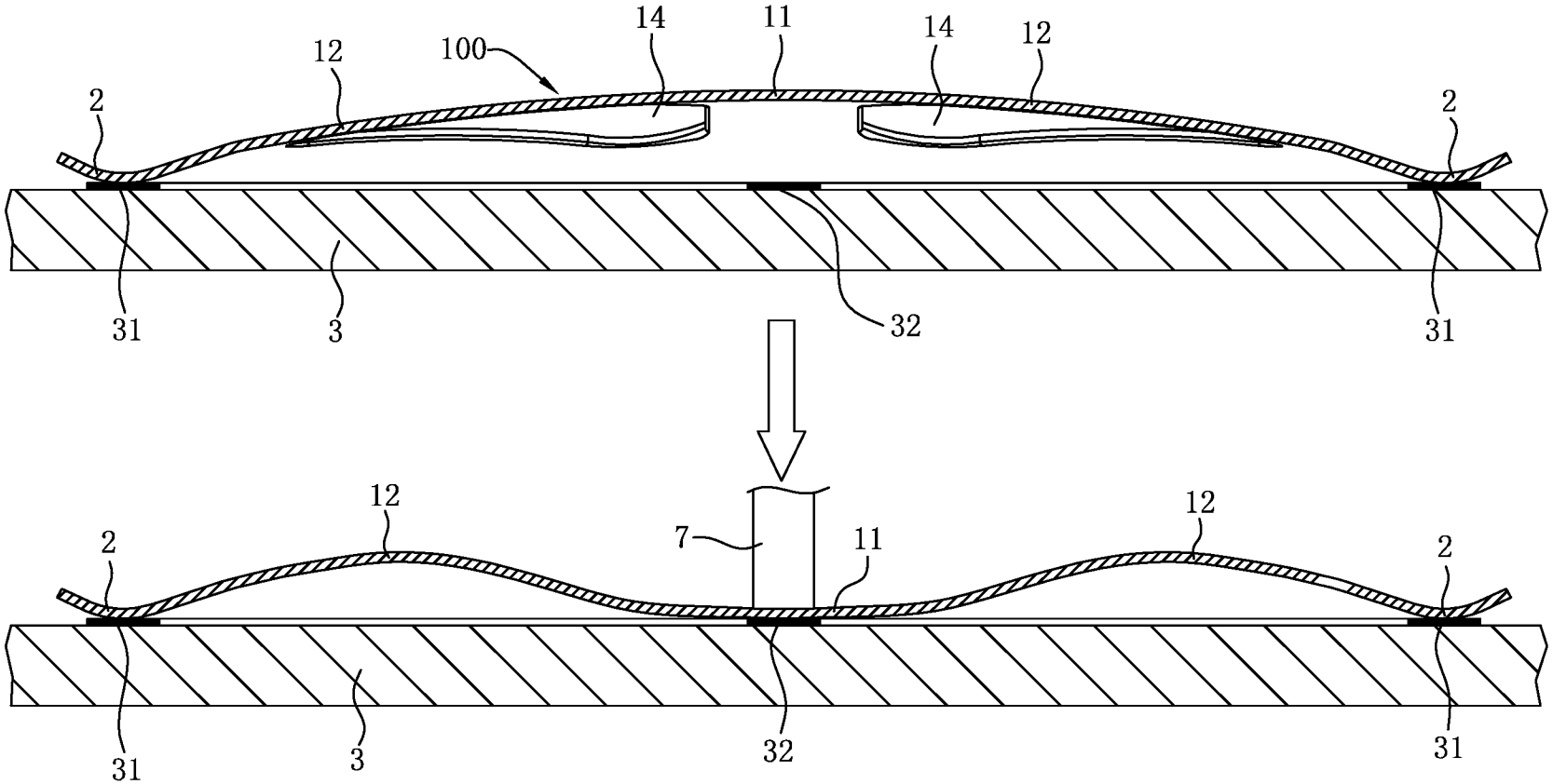
FIG. 6 is a schematic comparison view of a dome-shaped push switch before and after elastic deformation according to one embodiment of the present invention.

As shown in FIGS. 1, 2, and 6, according to one embodiment of the present invention, a dome-shaped push switch 100 is provided, which includes a dome-shaped pressing portion 1, and a support portion 2 used to be in contact with a substrate 3.

Figure 7:
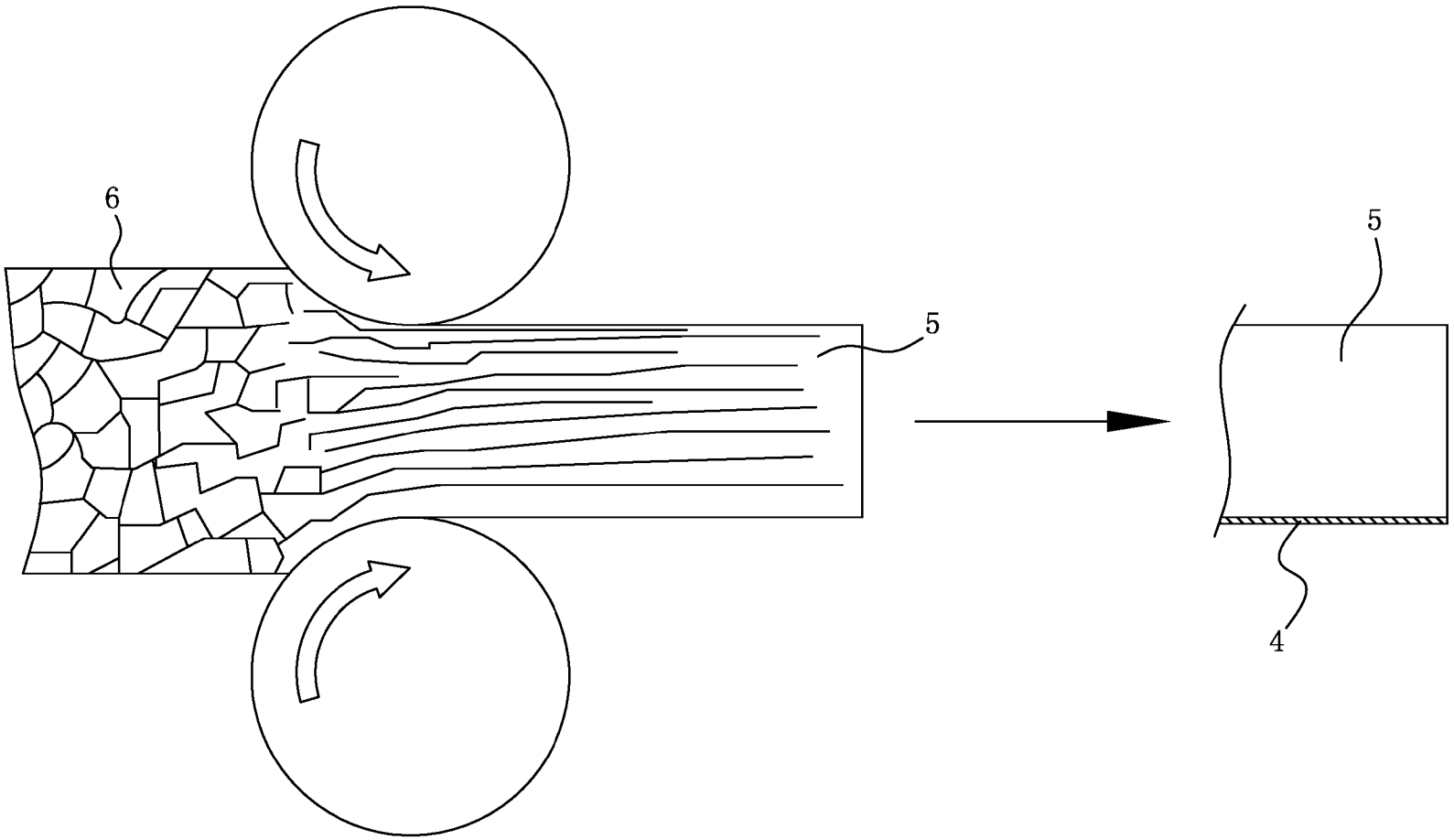
FIG. 7 is a schematic view of stretching a thick plate to a sheet according to one embodiment of the present invention.

As shown in FIGS. 1, 2, and 7, the pressing portion 1 is formed by enabling a metal sheet 5 to arch upward, and includes a sustaining portion 11 located at the central top of the pressing portion 1, a peripheral portion 13 located at an edge of the pressing portion 1, four elongated connection portions 12 connecting the sustaining portion 11 and the peripheral portion 13, and four through holes 14 symmetrically formed by the sustaining portion 11, the connection portions 12, and the peripheral portion 13. The sustaining portion 11 is configured to receive a pressure applied by a pressing member 7 toward the pressing portion 1. The four substantially triangular through holes 14 (in other embodiments, the through holes 14 may be of round shapes, ellipse shapes, square shapes, and the like) penetrate through the pressing portion 1. The four through holes 14 are symmetrically arranged at an area between the sustaining portion 11 and the peripheral portion 13, so as to ensure that a stress is uniformly distributed when the dome-shaped push switch 100 is pressed and is elastically deformed. Each of the connection portions 12 connects two of the through holes 14. In certain embodiments, the four connection portions 12 are of the same size and are substantially rectangle-shaped. The peripheral portion 13 has four substantially rectangle-shaped bridge portions 131. Each of the bridge portions 131 connects one ends of two adjacent connection portions 12.

Figure 8:
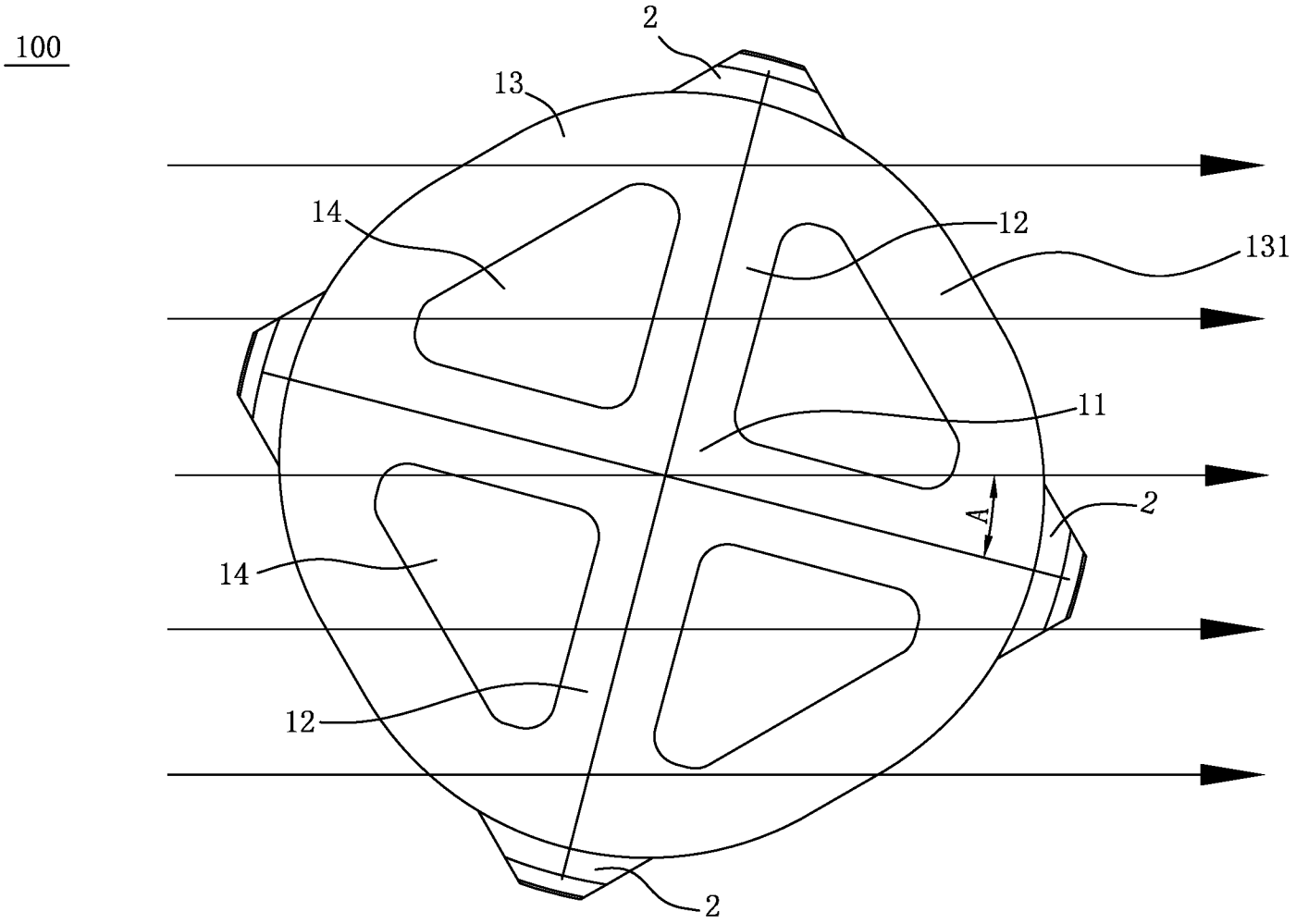
FIG. 8 is schematic view illustrating a relative position relationship between a stretching direction of the thick plate and a dome-shaped push switch according to one embodiment of the present invention.

As shown in FIG. 7, a lower surface of the sheet 5 is coated with a conducting layer 4 (usually a silver layer), and the conductivity of the conducting layer 4 is superior to the conductivity of the sheet 5. The sheet 5 is formed by stretching and extending a thick plate 6 along a direction (as shown in the direction of the arrow in FIG. 7) and then performing blanking. It should be noted that, at the micro level, when the thick plate 6 is stretched, grains of the thick plate 6 also extend along the stretching direction of the thick plate 6. For the sheet 5 obtained by stretching, if the sheet 5 is bent along the stretching direction of the thick plate 6, the sheet 5 is likely to be split, and if the sheet 5 is bent along a direction perpendicular to the stretching direction of the thick plate 6, the sheet 5 is unlikely to be split. As shown in FIG. 8, in certain embodiments, an angle A between a longitudinal direction of one of the four connection portions 12 and the stretching direction of the thick plate 6 (as shown in the direction of the arrow in FIG. 8) is between 15° and 35°, and in one embodiment, the angle A is 22.5°; and an angle between two adjacent connection portions 12 is 90°, so as to ensure that a longitudinal direction of each of the connection portions 12 and a longitudinal direction of each of the bridge portions 131 are not perpendicular to the stretching direction of the thick plate 6, that is, when the dome-shaped push switch 100 is pressed and is deformed, the connection portions 12 and the bridge portions 131 are not elastically bent along the stretching direction of the thick plate 6, thereby reducing a risk of generating splits when the connection portions 12 and the bridge portions 131 are elastically bent.

Figure 3A:
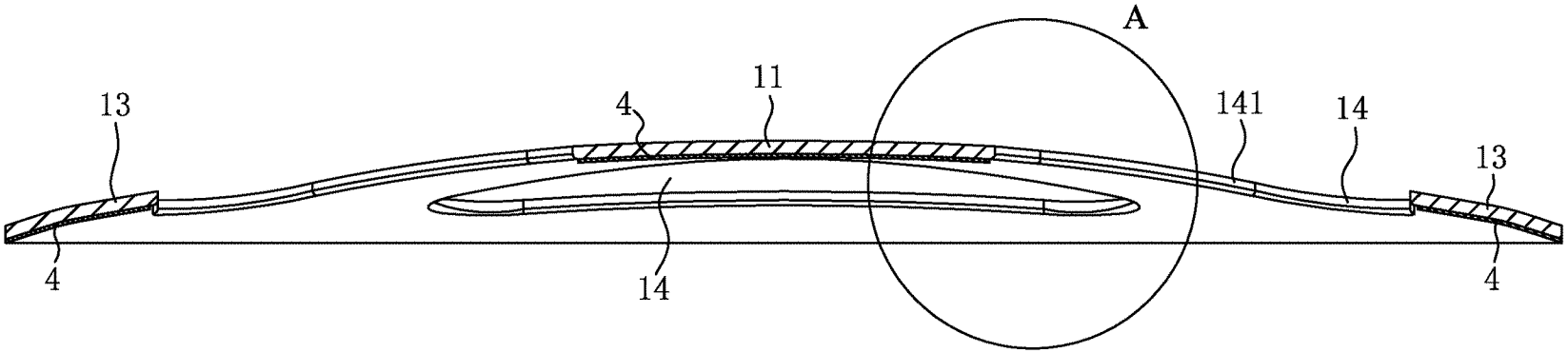
FIG. 3 is a sectional view of FIG. 2 along A-A.
Figure 3B:
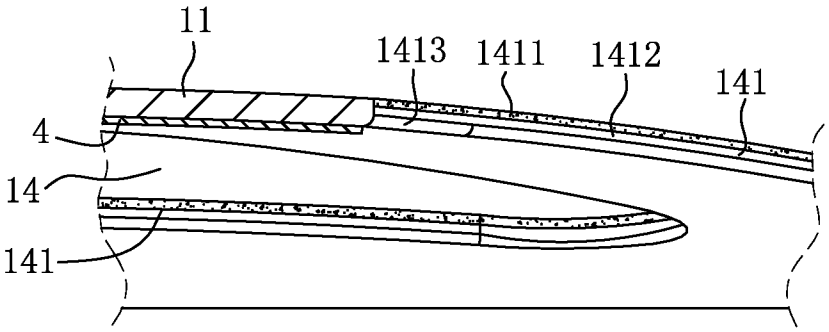

As shown in FIG. 3, the dome-shaped push switch 100 is obtained by performing blanking on the sheet metal 5 to form the through holes 14, and then punching and bending the sheet metal 5 to form the arched pressing portion 1, where a blanking direction for forming the through holes 14 is consistent with an arching direction of the pressing portion 1. In certain embodiments, a process of forming the through holes 14 by performing blanking on the sheet metal 5 may be divided into three stages: a first stage is elastic deformation, where when a punch of a punching die is in contact with the sheet metal 5, the punch continues advancing to a blanking direction, the sheet metal 5 is affected by a shrinkage stress and is elastically deformed, and a cross section of the sheet metal 5 forms a fillet 1413; a second stage is plastic deformation, where when the punch continues penetrating towards the blanking direction, the sheet metal 5 yields after achieving the limit of elasticity due to an increase of the shrinkage stress, and is subjected to plastic deformation, and the cross section forms a smooth shear surface 1412; and a third stage is crack and separation, where when a tensile stress in the sheet metal 5 continues increasing and achieves a maximum bearable strength of the sheet metal 5, a cut surface of the sheet metal 5 is subjected to irregular cracks and separations, and the cross section forms a rough tear surface 1411. Therefore, it can be observed under an electron microscope that, a side wall 141 (i.e., a blanking cross section formed during a blanking process) of each of the through holes 14 sequentially has a rough tear surface 1411 and a smooth shear surface 1412 from top to bottom, the tear surface 1411 extends downward from an upper edge of the side wall 141 to the shear surface 1412, and a fillet 1413 is provided between the shear surface 1412 and a lower surface of the pressing portion 1.

Figure 4A:
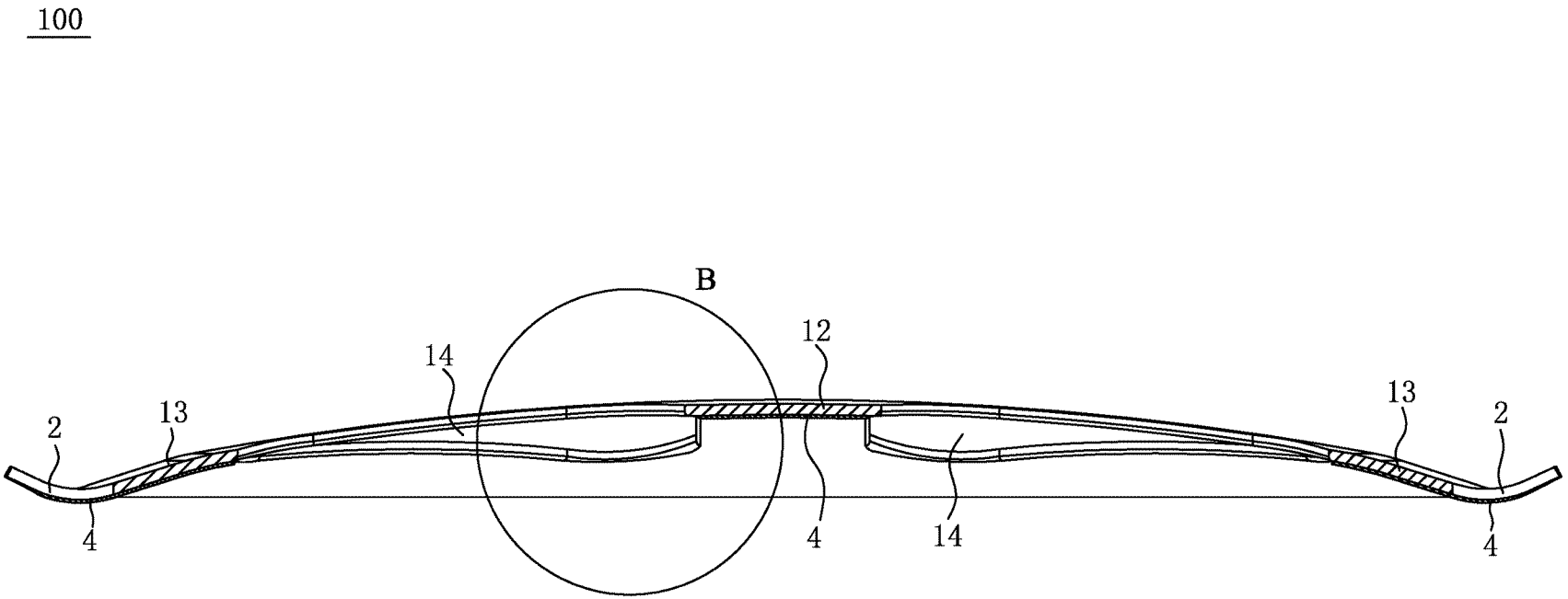
FIG. 4 is a sectional view of FIG. 2 along B-B.
Figure 4B:
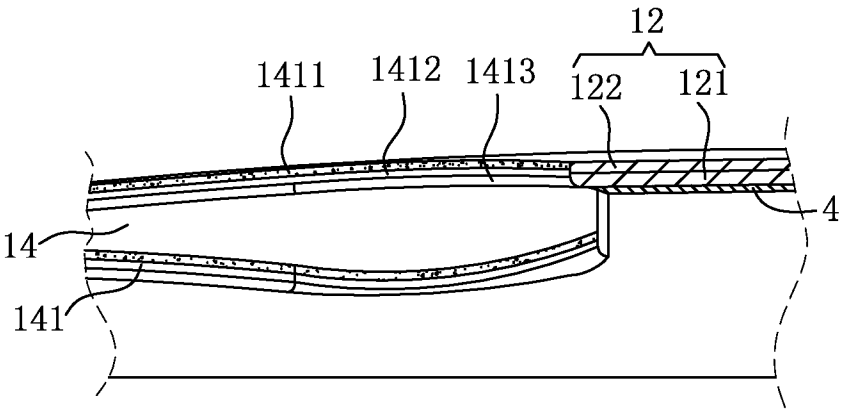

As shown in FIGS. 4 and 6, when the dome-shaped push switch 100 is pressed and is elastically deformed, the dome-shaped push switch 100 is subjected to partial contraction and partial expansion, and the connection portions 12 are subjected to more severe partial contraction and partial expansion. An elastic deformation state of each of the connection portions 12 may be analyzed by dividing the connection portion 12 into two layers along a thickness direction, an inner layer 121 and an outer layer 122. The inner layer 121 of the connection portion 12 has an increase in size and is elastically expanded, and the outer layer 122 of the connection portion 12 has a decrease in size and is elastically contracted. When the pressing portion 1 is pressed repeatedly for multiple times, the inner layer 121 of the connection portion 12 is accordingly subjected to repeated elastic expansion. Therefore, a cross section of the inner layer 121 of the connection portion 12 is likely to generate a crack. The side wall 141 sequentially has a tear surface 1411 and a shear surface 1412 from top to bottom, and thus, the cross section of the inner layer 121 of the connection portion 12 includes the shear surface 1412. Therefore, the feature of a high tear resistance of the shear surface 1412 is sufficiently used to improve a tear resistance of the inner layer 121 of the connection portion 12, thereby reducing a risk of generating a crack on the inner layer 121 of the connection portion 12, and effectively improving the overall durability of the dome-shaped push switch 100 and prolonging a service life of the dome-shaped push switch 100.

As shown in FIG. 6, the support portion 2 is formed by bending and extending obliquely upward from the edge of the pressing portion 1. In a naturally placed state, the support portion 2 is lower than the pressing portion 1. The support portion 2 abuts against a substrate 3 that supports the dome-shaped push switch 100, and is in contact with a first pad 31 of the substrate 3. When the pressing portion 1 is pressed and is elastically deformed, the sustaining portion 11 is in contact with a second pad 32 of the substrate 3, so as to conduct a circuit in the substrate 3.

Figure 5:
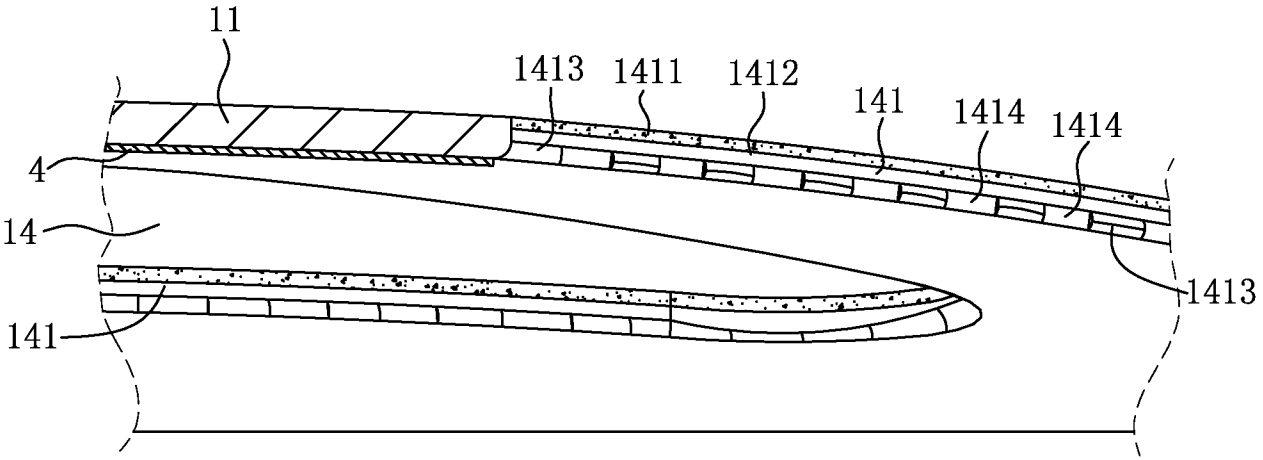
FIG. 5 is a partial enlarged sectional view of a dome-shaped push switch along B-B according to another embodiment of the present invention.

As shown in FIG. 5, in other embodiments, the fillet 1413 (particularly the position of the fillet 1413 included by the inner layer 121) may be further partially squeezed to form an angle of chamfer 1414. Therefore, when being observed from an electron microscope, the fillet 1413 may have one or more chamfers 1414. The fillet 1413 is squeezed, so that the position of the fillet 1413 has a decrease in size and is contracted, and a tensile stress at the position of the fillet 1413 is increased. However, when the dome-shaped push switch 100 is subjected to a downward pressure and is elastically deformed, the position of the fillet 1413 is expanded and generates a compressive stress. The tensile stress generated from the squeezing may partially offset the compressive stress generated when the dome-shaped push switch 100 is elastically deformed, so as to protect the dome-shaped push switch 100 and further strengthen the durability of the dome-shaped push switch 100.

Certain embodiments of the present invention, among other things, have the following beneficial advantages.

1. The dome-shaped push switch 100 according to certain embodiments of the present invention is obtained by performing blanking on the sheet metal 5 to form the through holes 14, and then punching and bending the sheet metal 5 to form the arched pressing portion 1. A blanking direction for forming the through holes 14 is consistent with an arching direction of the pressing portion 1, so as to ensure that the side wall 141 sequentially has a tear surface 1411 and a shear surface 1412 from top to bottom, and thus, the cross section of the inner layer 121 of the connection portion 12 includes the shear surface 1412. Therefore, the feature of a high tear resistance of the shear surface 1412 is sufficiently used to improve a tear resistance of the inner layer 121 of the connection portion 12, thereby reducing a risk of generating a crack on the inner layer 121 of the connection portion 12, and effectively improving the overall durability of the dome-shaped push switch 100 and prolonging a service life of the dome-shaped push switch 100.

2. In certain embodiments of the present invention, the position of the fillet 1413 is squeezed, so as to increase a tensile stress at the position of the fillet 1413. When the dome-shaped push switch 100 is elastically deformed, the position of the fillet 1413 is expanded and generates a compressive stress. The tensile stress generated from the squeezing may partially offset the compressive stress generated when the dome-shaped push switch 100 is elastically deformed, so as to protect the dome-shaped push switch 100 and further strengthen the durability of the dome-shaped push switch 100.

3. In certain embodiments of the present invention, an angle A between a longitudinal direction of one of the four connection portions 12 and the stretching direction of the thick plate 6 is between 15° and 35°, and preferably, the angle A is 22.5°, and an angle between two adjacent connection portions 12 is 90°, so as to ensure that a longitudinal direction of each of the connection portions 12 and a longitudinal direction of each of the bridge portions 131 are not perpendicular to the stretching direction of the thick plate 6. That is, when the dome-shaped push switch 100 is pressed and is deformed, the connection portions 12 and the bridge portions 131 are not elastically bent along the stretching direction of the thick plate 6, thereby reducing a risk of generating splits when the connection portions 12 and the bridge portions 131 are elastically bent.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A dome-shaped push switch, comprising:

a sheet having a pressing portion arching upward; and a conducting layer disposed at a lower surface of the sheet, a conductivity of the conducting layer being greater than that of the sheet, wherein the pressing portion comprises at least one through hole penetrating through the pressing portion, the at least one through hole has a side wall, the side wall sequentially has a shear surface and a tear surface from bottom up, and a fillet is provided between the shear surface and a lower surface of the pressing portion, and wherein a roughness of the tear surface is greater than a roughness of the shear surface.

2. The dome-shaped push switch of claim 1, wherein the tear surface extends downward from an upper edge of the side wall to the shear surface.

3. The dome-shaped push switch of claim 1, wherein the pressing portion comprises a sustaining portion located at a top of the pressing portion, and configured to receive a pressing member, a pressure is applied to the pressing portion by the pressing member, and the through hole is located around the sustaining portion.

4. The dome-shaped push switch of claim 1, wherein the sheet further comprises a support portion disposed at an edge of the pressing portion, for contacting with a substrate.

5. The dome-shaped push switch of claim 4, wherein the support portion is formed by bending and extending obliquely upward from the edge of the pressing portion.

6. The dome-shaped push switch of claim 4, wherein the substrate has a first pad, and the support portion is in contact with the first pad.

7. The dome-shaped push switch of claim 6, wherein the substrate has a second pad, and the pressing portion is in contact with the second pad after the pressing portion is pressed.

8. A dome-shaped push switch, comprising:

a sheet having a pressing portion arching upward;

a conducting layer disposed at a lower surface of the sheet, a conductivity of the conducting layer being greater than that of the sheet; and a chamfer, wherein the pressing portion comprises at least one through hole penetrating through the pressing portion, the at least one through hole has a side wall, the side wall sequentially has a shear surface and a tear surface from bottom up, a fillet is provided between the shear surface and a lower surface of the pressing portion, and the chamfer is disposed at a part of the fillet.

9. The dome-shaped push switch of claim 8, wherein the chamfer is formed by squeezing.

10. The dome-shaped push switch of claim 8, wherein the tear surface extends downward from an upper edge of the side wall to the shear surface.

11. The dome-shaped push switch of claim 8, wherein the sheet further comprises a support portion disposed at an edge of the pressing portion, for contacting with a substrate.

12. The dome-shaped push switch of claim 11, wherein the support portion is formed by bending and extending obliquely upward from the edge of the pressing portion.

13. A dome-shaped push switch, comprising:

a sheet having a pressing portion arching upward; and a conducting layer disposed at a lower surface of the sheet, a conductivity of the conducting layer being greater than that of the sheet, wherein the pressing portion comprises at least one through hole penetrating through the pressing portion, the at least one through hole has a side wall, the side wall sequentially has a shear surface and a tear surface from bottom up, and a fillet is provided between the shear surface and a lower surface of the pressing portion, and wherein the sheet is formed by stretching a thick plate along a direction, a number of the at least one through hole is four, a connection portion is provided between every two adjacent through holes of the four through holes, and an angle between a longitudinal direction of one of the connection portions and the stretching direction of the thick plate is between 15° and 35°.

14. The dome-shaped push switch according to claim 13, wherein an angle between two adjacent connection portions is 90°.

15. The dome-shaped push switch of claim 13, wherein the tear surface extends downward from an upper edge of the side wall to the shear surface.

16. The dome-shaped push switch of claim 13, wherein the sheet further comprises a support portion disposed at an edge of the pressing portion, for contacting with a substrate.

17. The dome-shaped push switch of claim 13, wherein the pressing portion comprises a sustaining portion located at a top of the pressing portion, and configured to receive a pressing member, a pressure is applied to the pressing portion by the pressing member, and the at least one through hole is located around the sustaining portion.

18. The dome-shaped push switch of claim 16, wherein the support portion is formed by bending and extending obliquely upward from the edge of the pressing portion.

19. The dome-shaped push switch of claim 16, wherein the substrate has a first pad, and the support portion is in contact with the first pad.

20. The dome-shaped push switch of claim 19, wherein the substrate has a second pad, and the pressing portion is in contact with the second pad after the pressing portion is pressed.

* * * * *